US009228699B2

(12) United States Patent
Sheu

(10) Patent No.: US 9,228,699 B2
(45) Date of Patent: Jan. 5, 2016

(54) LED LAMP

(71) Applicant: HON HAI PRECISION INDUSTRY CO., LTD., New Taipei (TW)

(72) Inventor: Yi-Zhong Sheu, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 185 days.

(21) Appl. No.: 13/968,382

(22) Filed: Aug. 15, 2013

(65) Prior Publication Data

US 2014/0160758 A1 Jun. 12, 2014

(30) Foreign Application Priority Data

Dec. 11, 2012 (TW) ..... 101146488 A

(51) Int. Cl.

| | |
|---|---|
| ***F21V 1/00*** | (2006.01) |
| ***F21K 99/00*** | (2010.01) |
| ***F21S 2/00*** | (2006.01) |
| ***F21V 23/06*** | (2006.01) |

(52) U.S. Cl.

CPC . *F21K 9/175* (2013.01); *F21K 9/30* (2013.01); *F21S 2/005* (2013.01); *F21V 23/06* (2013.01)

(58) Field of Classification Search

CPC ..... F21S 2/005; F21K 9/30; F21V 5/007
USPC ..... 362/238, 249.02, 240
See application file for complete search history.

(56) References Cited

U.S. PATENT DOCUMENTS

| | | | | |
|---|---|---|---|---|
| 8,132,935 | B2 * | 3/2012 | Park et al. | 362/235 |
| 2005/0007780 | A1 * | 1/2005 | Feuerborn et al. | 362/257 |
| 2006/0215405 | A1 * | 9/2006 | Jung et al. | 362/249 |
| 2006/0250832 | A1 * | 11/2006 | Su et al. | 365/1 |
| 2009/0267533 | A1 * | 10/2009 | Lee | 315/294 |
| 2010/0118532 | A1 * | 5/2010 | Liang et al. | 362/235 |
| 2010/0149783 | A1 * | 6/2010 | Takenaka et al. | 362/84 |
| 2011/0211375 | A1 * | 9/2011 | Uno | 363/74 |
| 2011/0221482 | A1 * | 9/2011 | Kim et al. | 327/109 |
| 2012/0020057 | A1 * | 1/2012 | Lin | 362/147 |
| 2012/0044669 | A1 * | 2/2012 | Ogata et al. | 362/97.3 |

* cited by examiner

*Primary Examiner* — Evan Dzierzynski
(74) *Attorney, Agent, or Firm* — Novak Druce Connolly Bove + Quigg LLP

(57) ABSTRACT

An LED lamp includes a lamp body and a plurality of LED modules. The lamp body defines a pair of inserting holes in each of two opposite sides thereof. The LED modules each have a pair of inserting pins at a side thereof and a pair of inserting holes in an opposite side thereof. In assembly, the LED modules are electrically connected to the lamp body via inserting the inserting pins of the LED modules into the inserting holes of the lamp body and into the inserting holes of adjacent LED modules. In disassembly, the LED modules are detached from the lamp body and the adjacent LED modules via pulling the inserting pins of the LED modules out of the inserting holes of the lamp body and the adjacent LED modules.

16 Claims, 2 Drawing Sheets

LED LAMP

BACKGROUND

1. Technical Field

The present disclosure relates to LED (light emitting diode) lamps and, more particularly, to an improved LED lamp which can change light-emitting form according to actual need.

2. Description of Related Art

An LED lamp as a new type of light source can generate brighter light, and have many advantages, e.g., energy saving, environment friendly and longer life-span, compared to conventional light sources. Therefore, the LED lamp has a trend of substituting for conventional lamps.

A conventional LED lamp comprises a plurality of LED modules. In use of the LED lamp, light generated by the LED modules directly irradiates to an outside of the LED lamp. Since the LED modules are arranged in a certain form tightly/firmly, light produced by the LED module can only illuminate toward a singular direction. It is difficult to rearrange the LED modules as desired, whereby an application of the LED lamp is prohibited in some fields which need to arrange LED modules in different forms to meet different requirements of illumination.

What is needed, therefore, is an LED lamp which can overcome the limitations described.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
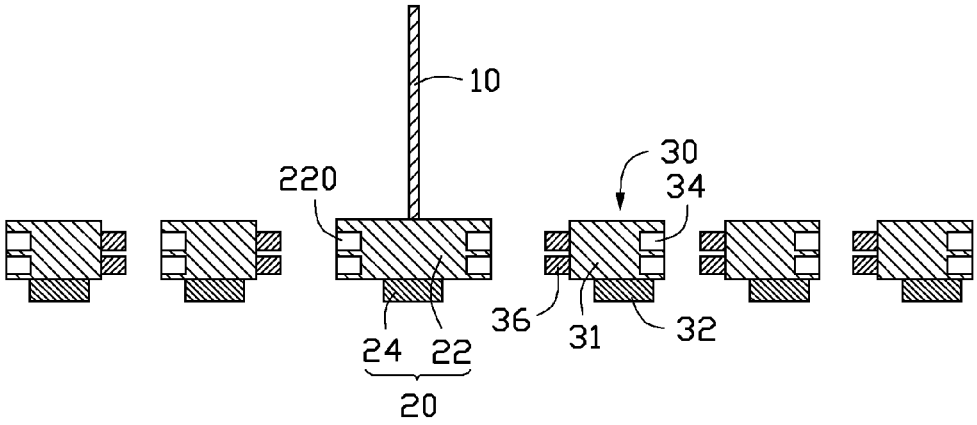
FIG. 1 is a cross-section view of an LED lamp in accordance with an embodiment of the disclosure.

Referring to FIG. 1, an LED lamp used for an indoor illumination in accordance with an embodiment of the disclosure includes a position post 10, a lamp body 20 mechanically connecting with the position post 10, and a plurality of LED modules 30 mechanically and electrically connecting with the lamp body 20.

The position post 10 is a cylindrical metal pole. A top end of the position post 10 is fastened to a ceiling of an architecture (not shown) for positioning the LED lamp at a desired location. A bottom end of the position post 10 is fixed to the lamp body 20.

The lamp body 20 includes a voltage converting module 22 and a plurality of LEDS 24 mounted at a bottom of the voltage converting module 22. The voltage converting module 22 is provided for converting an alternating current into a direct current, to thereby supply the required power for the LEDS 24 and the LED modules 30 to work. Each of two opposite lateral sides (left side and right side) of the voltage converting module 22 defines a pair of inserting holes 220. The LEDS 24 can be selected for emitting light of a same color or different colors according to different requirements.

Each of the LED modules 30 includes a main body 31, a plurality of LEDS 32 mounted at a bottom of the main body 31, and a pair of inserting pins 36 horizontally extending from a lateral side (left side of the right LED modules 30, or right side of the left LED modules 30) of the main body 31. The main body 31 of each LED module 30 defines a pair of inserting holes 34 in another lateral side thereof, corresponding to the pair of inserting pins 36 of an adjacent LED module 30. The LEDS 32 of each LED module 30 can be selected for emitting light of a same color or different colors according to different requirements.

Figure 2:
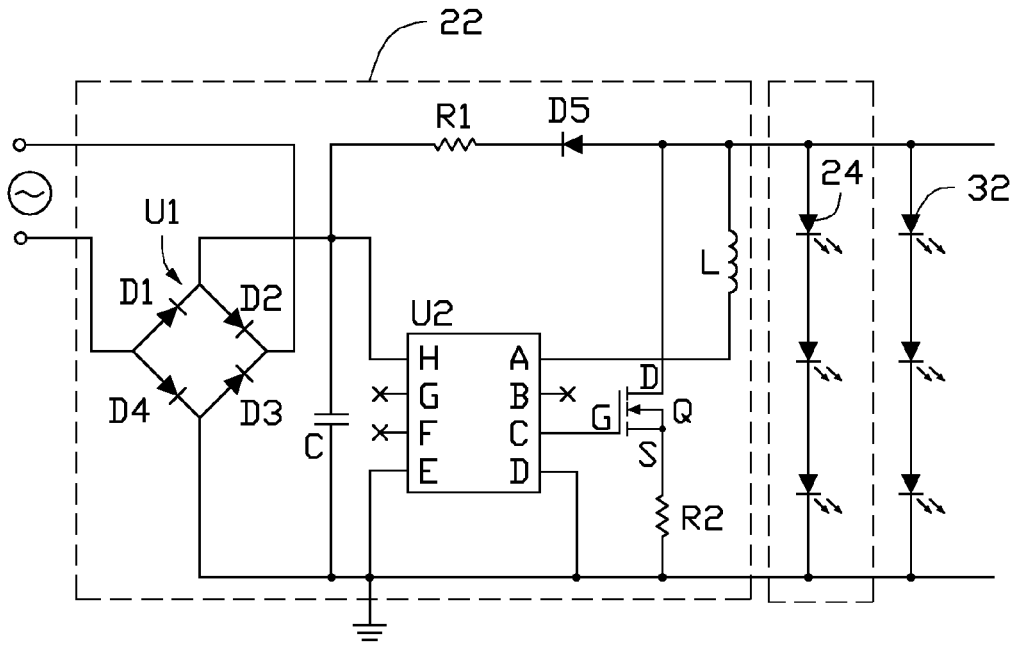
FIG. 2 is a circuit diagram of the LED lamp of FIG. 1.

FIG. 2 shows a circuit diagram of the LED lamp. The voltage converting module 22 includes a rectifier bridge U1 and a converting chip U2. The rectifier bridge U1 includes four diodes D1~D4 connected end to end. A pair of ports of the rectifier bridge U1 are connected with an alternating current power source, another pair of ports of the rectifier bridge U1 are connected with a pin H and a pin E of the converting chip U2, respectively. Two ends of a capacitor C are connected between the another pair of ports of the rectifier bridge U1. A pin D and the pin E of the converting chip U2 are connected with ground. A resistors R1, a diode D5 and an inductance L are connected in series, and are connected between a pin H and a pin A of the converting chip U2. A gate electrode G of a field effect transistor (FET) Q is connected with a pin C of the converting chip U2. A drain electrode D of the field effect transistor Q is connected between the diode D5 and the inductance L. A source electrode S of the field effect transistor Q is connected with ground via a resistors R2. The plurality of LEDS 24 are connected in series, and are connected between two output ports of the voltage converting module 22. The plurality of LEDS 24 and the plurality of LEDS 32 of each LED module 30 are connected in parallel.

In assembly, the LED module 30 is electrically connected to the lamp body 20 via inserting the inserting pins 36 of the LED module 30 into the inserting holes 220 of the lamp body 20; every two adjacent LED modules 30 are electrically connected together via inserting the inserting pins 36 of each LED module 30 into the inserting holes 34 of an adjacent LED module 30. In disassembly, the LED module 30 is detached from lamp body 20 via pulling the inserting pins 36 of the LED module 30 out of the inserting holes 220 of the lamp body 20; every two adjacent LED modules 30 are detached from each other via pulling the inserting pins 36 of each LED module 30 out of the inserting holes 34 of the adjacent LED module 30.

In the LED lamp of the present disclosure, different numbers of LED modules 30 can be assembled on or detached from the lamp body 20, so that the LED modules 30 can be arranged in different forms to meet different requirements of illumination.

It is believed that the disclosure and its advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. An LED lamp, comprising:

a lamp body defining a pair of inserting holes in each of two opposite sides thereof; and at least one LED module having at least one pair of inserting pins at a side thereof;

wherein in assembly, the at least one LED module is electrically connected to the lamp body via inserting the at least one pair of inserting pins of the at least one LED module into the inserting holes of the lamp body, the at least one LED module being detachable from the lamp body via pulling the at least one pair of inserting pins of the at least one LED module out of the inserting holes of the lamp body, the lamp body having a plurality of LEDs which are electrically connected together in series, the at least one LED module having a plurality of LEDs which are electrically connected together in series, the LEDs of the lamp body being electrically connected with the LEDs of the at least one LED module in parallel, the at least one LED module comprises a plurality of LED modules, each of the plurality of LED modules having a pair of inserting pins at a side thereof and defining a pair of inserting holes in another side opposite to the pair of inserting pins, every two adjacent LED modules being electrically connected together via inserting the inserting pins of each LED module into the inserting holes of an adjacent LED module, every two adjacent LED modules being detachable from each other via pulling the inserting pins of each LED module out of the inserting holes of the adjacent LED module, the lamp body comprises a voltage converting module for converting an alternating current into a direct current, and the plurality of LEDs of the lamp body is mounted at a bottom of the voltage converting module and electrically connected to the voltage converting module, the voltage converting module comprising a rectifier bridge and a converting chip, the rectifier bridge comprises four diodes connected end to end, the converting chip comprises eight pins A-H, the pins A-D are located at a right column from a top side to a bottom side in turns, the pins E-H are located at a left column from the bottom side to the top side, a pair of ports of the rectifier bridge are connected with an alternating current power source, another pair of ports of the rectifier bridge are connected with the pin H and the pin E of the converting chip, respectively.

2. The LED lamp of claim 1, wherein the plurality of LED modules are electrically connected in parallel.

3. The LED lamp of claim 1, further comprising a position post, a top end of the position post being used for positioning the LED lamp at a desired location, a bottom end of the position post being fixed to the lamp body.

4. The LED lamp of claim 1, wherein the lamp body comprises a voltage converting module for converting an alternating current into a direct current, and the plurality of LEDs of the lamp body is mounted at a bottom of the voltage converting module and electrically connected to the voltage converting module.

5. The LED lamp of claim 4, wherein the pair of inserting holes of the lamp body are defined in the voltage converting module.

6. The LED lamp of claim 4, wherein the LEDs of the lamp body respectively emit light of different colors.

7. The LED lamp of claim 1, wherein each of the LED modules comprises a plurality of LEDs respectively emitting light of different colors.

8. The LED lamp of claim 1, wherein the pair of inserting holes of the lamp body are defined in the voltage converting module.

9. The LED lamp of claim 1, wherein the plurality of LEDs of the main body and the plurality of LEDs of each of the LED modules are connected in parallel.

10. The LED lamp of claim 1, the voltage converting further comprises a capacitor, two ends of the capacitor are connected between the another pair of ports of the rectifier bridge.

11. The LED lamp of claim 1, wherein the pin D and the pin E of the converting chip are connected with ground.

12. The LED lamp of claim 1, wherein the voltage converting further comprises a resistors, a diode and an inductance, the resistors, the diode and the inductance are connected in series, and are connected between the pin H and the pin A of the converting chip.

13. The LED lamp of claim 12, wherein the voltage converting further comprises a field effect transistor (FET), the field effect transistor comprises a gate electrode, the gate electrode is connected with the pin C of the converting chip.

14. The LED lamp of claim 13, wherein the field effect transistor comprises a drain electrode, the drain electrode is connected between the diode and the inductance.

15. The LED lamp of claim 13, wherein the voltage converting further comprises resistors, the field effect transistor comprises a source electrode, the source electrode is connected with ground via a resistors.

16. The LED lamp of claim 1, wherein the pin B, pin G and pin F is connected with nothing.

* * * * *